XR 4,049,987

1 X 350/1.5

United Sta

Helms

[11] 4,049,987

[45] Sept. 20, 1977

[54] OZONE ABSORBANCE CONTROLLER

[75] Inventor: Charles Carlyle Helms, Trumbull, Conn.

[73] Assignee: The Perkin-Elmer Corporation, Norwalk, Conn.

[21] Appl. No.: 692,658

[22] Filed: June 4, 1976

[51] Int. Cl.[2] ..... H01J 5/16; H01K 1/34

[52] U.S. Cl. ..... 313/112; 250/504; 250/510; 350/1; 356/51

[58] Field of Search ..... 313/110, 112; 250/504, 250/510; 356/51; 350/1; 128/395, 396, 190

[56] References Cited

U.S. PATENT DOCUMENTS

| | | | |
|---|---|---|---|
| 2,016,474 | 10/1935 | Wood | 250/504 |
| 2,326,773 | 8/1943 | Floyd | 313/112 |
| 2,538,685 | 1/1951 | Hansen et al. | 250/504 |
| 3,089,033 | 5/1963 | Fujisawa | 250/504 |
| 3,760,182 | 9/1973 | Poole | 250/504 |
| 3,956,655 | 5/1976 | Pevo | 313/112 |

*Primary Examiner*—John Kominski

*Attorney, Agent, or Firm*—S. A. Giarratana; F. L. Masselle; J. D. Crane

[57] ABSTRACT

An ozone absorbance controller for use with an ultraviolet light source, which includes a vented, trapped gas filter disposed in the optical emission path of said ultraviolet light source to absorb high energy ultraviolet rays of wavelengths below about 200 nanometers, and thereby substantially preventing the formation of ozone in the optical emission path subsequent to the filter.

8 Claims, 1 Drawing Figure

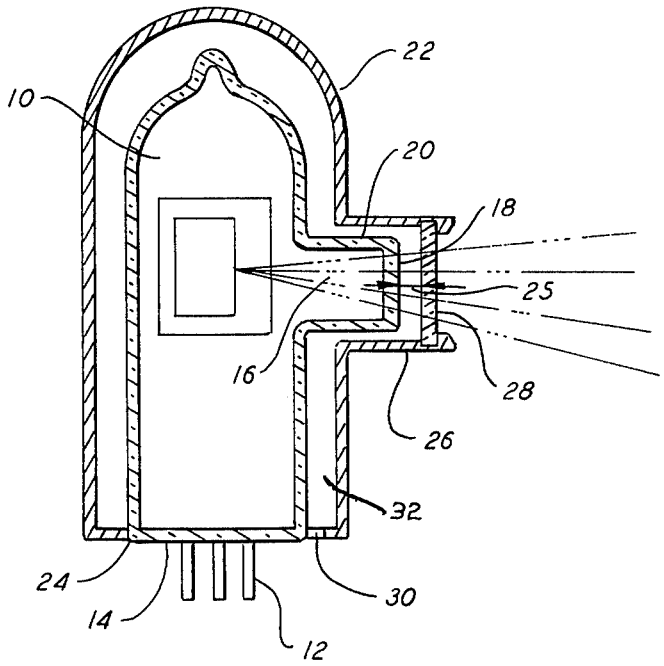
22
10
20
18
25
16
28
26
32
24
30
14
12

OZONE ABSORBANCE CONTROLLER

BACKGROUND OF THE INVENTION

This invention relates to ultraviolet (UV) light sources, and more particularly to the prevention or control of the formation of ozone from such sources.

The invention is particularly adapted, among other possible uses, for use with spectrophotometers, for example. Many biological, physiological, or chemical phenomena are analyzed by passing light through solutions, suspensions, or other liquid samples and detecting the reflection or transmission characteristics thereof. Such spectrophotometers include a high energy source which may, for example, be a deuterium or xenon arc lamp for providing light throughout a wavelength range approximately 190–360 nanometers (nm.).

It is known that oxygen absorbs ultraviolet (UV) emission in the wavelength range below approximately 200 nm. This absorption causes a change of state to ozone, and thus at the window of an UV source in an air environment ozone is generated. Ozone absorbs at wavelength bands of about 254 nm. and at about 600 nm. It will be appreciated that the generation of ozone in the optical path of a spectrophotometer changes the energy throughput of the instrument, which is normally a noisy process. These instruments are very delicate in nature and, hence, any variation in energy throughput is a significant factor in the overall performance of the instrument. Moreover, various governmental agencies issue regulations for ozone emission which must be complied with Heretofore, attempts have been made to overcome this problem by the provision of exhaust fans, hoods, deozonators, and the like. However, such devices have not been entirely successful and, accordingly, it is an object of the present invention to overcome or to reduce to insignificance this problem in a new and improved manner, as will become apparent as the description proceeds.

SUMMARY OF THE INVENTION

In order to accomplish the desired results, this invention provides a new and improved ozone absorbance controller for use with an ultraviolet light source comprising a vented, trapped gas, or air, filter disposed in the optical emission path of the ultraviolet source to absorb high energy ultraviolet rays of wavelengths below about 200 nanometers, and thereby substantially preventing the formation of ozone in the optical emission path subsequent or downstream of the filter. In one form of the invention, an envelope is disposed substantially around an ultraviolet lamp in spaced relationship with respect thereto,, said lamp having a transmission window and said envelope having a second transmission window substantially in alignment therewith. The spacing between the lamp and the envelope contains trapped gas, or air, and a vent opening to the ambient atmosphere from the envelope serves to maintain a stable equilibrium condition of air and ozone in this space, thereby providing a stable energy throughput. As a consequence, high energy UV waves are not present at the outside of the second window and, therefore, substantially no ozone is formed in the remainder of the optical path of the instrument.

BRIEF DESCRIPTION OF THE DRAWING

The FIGURE is a vertical, medial sectional view of an ozone absorbance controller, constructed in accordance with the concepts of this invention, mounted on a UV lamp.

DETAILED DESCRIPTION OF THE PREFERRED EMBODIMENT

As shown in the drawing, there is provided a source of high energy UV light, which in the form of the invention illustrated, is a conventional deuterium arc lamp 10 that emits light throughout a wavelength range of approximately 165 to 360 nm. Power for the lamp is supplied through socket means 12 at the base 14, and the light beam, indicated at 16, from the lamp is transmitted through a window 18 disposed at the end of a projecting portion 20, provided for the purpose. An envelope 22 is mounted on the base 14 as at 24, which substantially completely surrounds or encases the lamp 10, but in spaced relationship with respect thereto. This envelope may be fabricated from any suitable gas containing material. Preferably, the spacing 25 between the lamp 10 and the envelope 22 is in the range of from about 1.0 to about 3.0 millimeters, this spacing being substantially constant all around the lamp as illustrated in the drawing. The envelope 22 has a projecting portion 26 of a similar contour as that of the lamp projection 20, which carries a second window 28 at the end thereof, the two windows being disposed in alignment with respect to each other so that the beam of light 16 can pass therethrough. Both windows are fabricated from any suitable UV transmitting material such as fused silica, for example. In addition, the envelope 22 is provided with a pin hole or vent opening 30 disposed towar the base thereof, which provides a small leak to the ambient atmosphere. Preferably, the diameter of the vent opening is of the order of from about 0.25 millimeters to about 0.50 millimeters.

As shown in the drawing, the envelope 22 is disposed in spaced relationship with respect to the lamp 10, thereby forming an intermediate chamber 32 therebetween. This intermediate chamber is filled with trapped air which provides a filter effect in the emission path of the UV light source. In operation, when the lamp is turned on, the oxygen in the intermediate chamber absorbs the high energy UV rays below about 200 nm. As the gas in this chamber heats up, while being vented through the vent opening in the bottom thereof, the conditions in this chamber soon reach a stable equilibrium state of air and ozone. When this equilibrium state is reached, the energy throughput from the lamp is thereafter stable. As a consequence, there is substantially no high energy UV rays present outside of the second window and, hence, substantially no ozone is formed in the remainder of the optical path of the instrument.

There has thus been described a new and improved ozone absorbance controller, which substantially eliminates the change in absorbance in the optical path of the instrument, and which reduces the physical and chemical effects caused by the presence of ozone. Although a specific embodiment has been illustrated and described, it will be obvious to those skilled in the art that various modifications may be made without departing from the spirit of the invention, which is intended to be limited solely by the appended claims.

What is claimed is:

1. An ozone absorbance controller for use with an untraviolet light source comprising a trapped gas filter disposed in an optical emission path of said ultraviolet light source to absorb high energy ultraviolet rays of wave lengths below about 200 nanometers, and to thereby substantially prevent the formation of ozone in said optical emission path subsequent to said filter, said trapped gas filter being vented with a single opening sufficiently large to permit pressure equalization between the gases in the filter and atmosphere yet small enough to prevent gas movement within the gas filter after pressure equalization.

2. An ozone absorbance controller for use with an ultraviolet light source according to claim 1 wherein said trapped gas is a body of air vented to ambient atmosphere.

3. An ozone absorbance controller for use with an ultraviolet lamp comprising an envelope disposed substantially around said lamp in spaced relationship with respect thereto, said lamp having a transmission window and said envelop having a second transmission window substantially in alignment therewith, each said window being made of an ultraviolet transmitting material, said space between the lamp and the envelope containing a trapped gas, and said envelope having a vent opening to ambient atmosphere for said trapped gas, said vent comprising a single opening sufficiently large to permit pressure equalization of said trapped gas and ambient atmosphere yet small enough to prevent gas movement in the region disposed between said windows after pressure equalization.

4. An ozone absorbance controller for use with an ultraviolet lamp according to claim 3 wherein said trapped gas is air.

5. An ozone absorbance controller for use with an ultraviolet lamp according to claim 3 wherein said lamp is a deuterium arc lamp.

6. An ozone absorbance controller for use with an ultraviolet lamp according to claim 3 wherein said envelope is spaced from said lamp a distance of the order of from about 1.0 to about 3.0 millimeters.

7. An ozone absorbance controller for use with ultraviolet lamp according to claim 3 wherein said vent opening is disposed towards the bottom of said envelope.

8. An ozone absorbance controller for use with an ultraviolet lamp according to claim 7 wherein said vent opening has a diameter of from about 0.25 millimeters to about 0.50 millimeters.

* * * * *

UNITED STATES PATENT AND TRADEMARK OFFICE

CERTIFICATE OF CORRECTION

PATENT NO. : 4,049,987

DATED : September 20, 1977

INVENTOR(S) : CHARLES CARLYLE HELMS

It is certified that error appears in the above-identified patent and that said Letters Patent are hereby corrected as shown below:

Column 1, line 32, after "with" insert --.--.

Column 1, line 56, after "thereto" delete one of the commas.

Column 2, line 35, delete "towar" and insert in place thereof --toward--.

Column 3, line 21, delete "envelop" and insert in place thereof --envelope--.

Signed and Sealed this

*Thirty-first* Day of *January 1978*

[SEAL]

*Attest:*

RUTH C. MASON
*Attesting Officer*

LUTRELLE F. PARKER
*Acting Commissioner of Patents and Trademarks*